US005311620A

United States Patent [19]

Ratje

[11] Patent Number: 5,311,620

[45] Date of Patent: May 17, 1994

[54] OUTDOOR PORTABLE SHOWER

[76] Inventor: James P. Ratje, 753 Stagecoach Dr., Las Cruces, N. Mex. 88011

[21] Appl. No.: 72,531

[22] Filed: Jun. 4, 1993

[51] Int. Cl.[5] ..... A47K 3/23

[52] U.S. Cl. ..... 4/599; 4/602; 4/603

[58] Field of Search ..... 4/585, 588, 599, 602, 4/603, 612, 613, 614; 128/202.13, 202.14, 202.15, 202.16, 202.17, 202.18, 202.19, 205.26

[56] References Cited

U.S. PATENT DOCUMENTS

| | | | |
|---|---|---|---|
| 2,854,049 | 9/1958 | Wyllie | 4/585 |
| 2,990,837 | 7/1961 | Cushman | 4/506 |
| 3,332,091 | 7/1967 | Greer | 4/155 |
| 3,431,565 | 3/1969 | Nelson | 4/154 |
| 3,590,398 | 7/1971 | Jetter | 4/154 |
| 3,606,618 | 9/1971 | Veech | 4/147 |
| 3,629,875 | 12/1971 | Dow | 4/146 |
| 3,657,746 | 4/1972 | Downey | 4/155 |
| 3,710,791 | 1/1973 | Deaton | 128/191 A |
| 3,768,467 | 10/1973 | Jennings | 128/205.26 |
| 3,925,828 | 12/1975 | Kim | 4/147 |
| 4,023,220 | 5/1977 | Younker | 4/585 |
| 4,453,280 | 6/1984 | Greenleaf | 4/599 |
| 4,539,720 | 9/1985 | Westerweller | 4/599 |
| 4,607,400 | 8/1986 | Goodman | 4/506 |
| 4,858,755 | 8/1989 | Kuivanen | 4/588 |
| 4,866,794 | 10/1989 | Davies | 4/599 |
| 5,216,763 | 6/1993 | Grenier | 4/900 |
| 5,247,712 | 9/1993 | Williams | 4/585 |

*Primary Examiner*—Henry J. Recla
*Assistant Examiner*—Charles R. Eloshway

[57] ABSTRACT

An improved portable shower having a one piece inflatable enclosure anchored to the ground by filling the bottom ring with water or alternately using provided flaps with eyelets to stake it to the ground. A common water sprayer having a modified air pump that can be used to inflate the enclosure, a positionable spray nozzle to direct water stream more effectively, and an extended hose for overhead reach when water container is upright on the ground.

3 Claims, 2 Drawing Sheets

OUTDOOR PORTABLE SHOWER

BACKGROUND—FIELD OF INVENTION

This invention relates to portable personal shower equipment, specifically to such equipment that can be used outdoors in a variety of remote locations.

BACKGROUND—DESCRIPTION OF PRIOR ART

Prior art of outdoor portable shower equipment goes back many years and presently has yielded few marketable versions. Of those versions presently on the market, each design leans toward simplicity, ease of use and economy of manufacture.

One version is similar to U.S. Pat. No. 4,866,794 issued to Roy O. Davies Sep. 19, 1989 of which a curtain is erected through the use of a round floor support, a snap together ring at the top and a method of overhead rigging with a bucket to supply shower water. A variation of this would be to use an inflatable tube at the top and bottom of the curtain and a pliable bag to hold the shower water. The disadvantage of this type of shower is that a tree or some other means of overhead rigging is necessary to erect the unit. Further, a potential hazard exists from the water bag or bucket being suspended or held overhead should the rigging give way.

U.S. Pat. No. 4,539,720 filed Sep. 10, 1985 by Constance D. Westerweller describes a portable shower that does not depend on external rigging means. Though this design is noteworthy with respect to increased utility it suffers from the disadvantage that is common in the prior art and that is of having a large number of parts that must be assembled to make the unit operational.

Other patents suggest structures fashioned of telescoping rods, rigid collapsible columns, ring supports and the like that actually detract from the economy of manufacturing and utility of such units.

U.S. Pat. Nos. 4,453,280 (Greenleaf Jun. 12, 1984), 3,925,828 (Kim Dec. 16, 1975), 3,657,746 (Downey Apr. 25, 1972), 3,629,875 (Dow Dec. 28, 1971), 3,606,618 (Veech Sep. 21, 1971), 3,590,398 (Jetter Jul. 6, 1971), 3,431,565 (Nelson Mar. 11, 1969) and 3,332,091 (Greer Jan. 25, 1967) bear one or more of the disadvantages discussed above.

OBJECTS AND ADVANTAGES

The objects of this invention are to provide an improved device for outdoor bathing that is economical to produce, easy to erect and dismantle and which is safe and efficient as well as practical to use.

DRAWING FIGURES

Further objects and advantages may be realized upon examination of the drawings of which:

DESCRIPTION—FIGS. 1 to 4

Figure 1:
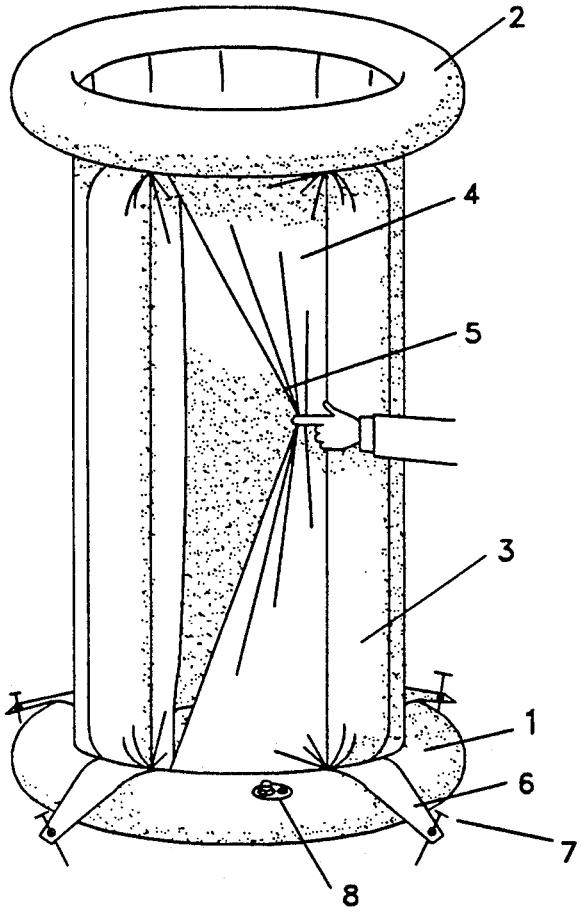
FIG. 1 is a perspective view of the self standing enclosure as described in this invention.

An embodiment of the shower enclosure of the present invention is presented in FIG. 1. The one piece self standing enclosure is an inflatable structure of sheet vinyl or reinforced sheet material suitable for use in such an application. The basic structure consists of a bottom inflatable ring 1 and a top inflatable ring 2 and are held apart by a number of inflatable column tubes 5 which are placed perpendicularly between the top ring 2 and the bottom ring 1. The surrounding wall 4 of the unit are formed by a sheet vinyl or reinforced sheet material that is permanently fastened between the top ring 2 and the bottom ring 1 and the columns 5, side to side along the circumference of the unit. The enclosure entrance opening 5 is formed by vertically overlapping the side to side ends of the material of the surrounding wall piece 6 as the top and bottom of it are fastened to the circumference of the top ring 2 and bottom ring 1. The base ring 1 may be filled with water in order to anchor the enclosure to the ground. Optionally, the enclosure may be anchored to the ground via stakes 7 and flaps with eyelets 6 which are appropriately attached to the base of the shower enclosure.

Figure 2:
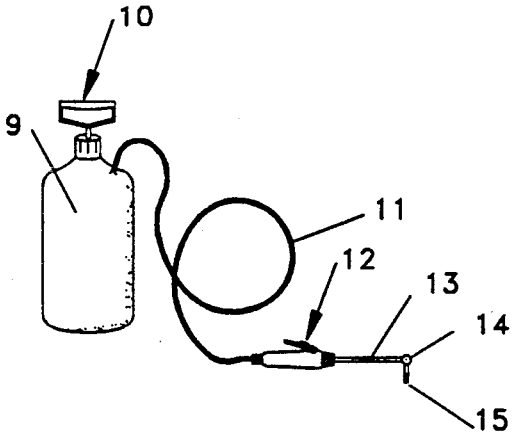
FIG. 2 is a view of the modified water sprayer showing the positionable sprayer nozzle as described in this invention.
Figure 3:
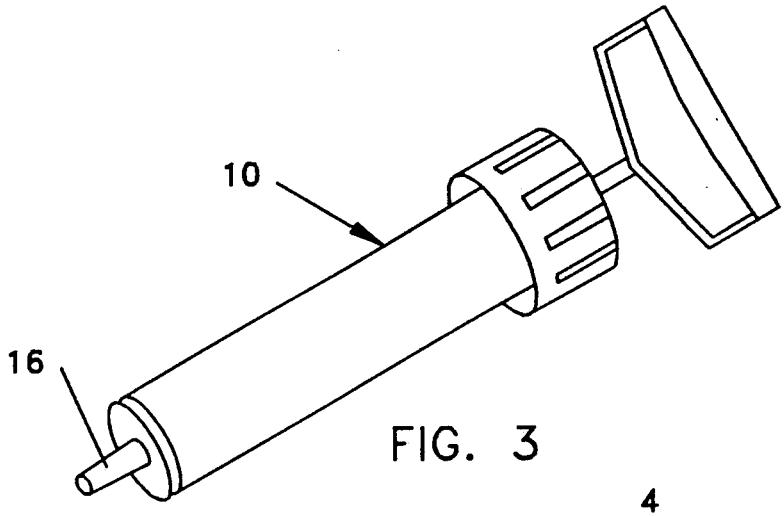
FIG. 3 is an enlarged view of the air pump of the pump sprayer assembly showing the nozzle used to inflate the self standing enclosure.

FIG. 2 shows the air powered water sprayer and its parts. The water sprayer is a commonly marketed model having a hand held wand with locking valve 12 and a wand tube 13 rotatable on the wand tube axis. The wand tube of the commonly marketed model (not shown) normally comes with an approximately 20 degree fixed bend near the nozzle and is not practical for a person to use as a shower sprayer in that configuration. Therefore, the water sprayer unit of the present invention has three important modifications. Of the hose 11, the length is extended to provide adequate positioning of the sprayer nozzle 15 over ones head while the sprayer bottle 1 is upright on the ground. Of the wand 13, it is modified to have a bent neck greater than 90 degrees or a swiveling device 14 to conveniently direct the spray where it is needed. Of the air pump assembly 10, shown in FIG. 3, a special nozzle attachment 16 allows it to be used to inflate the shower enclosure unit.

Figure 4:
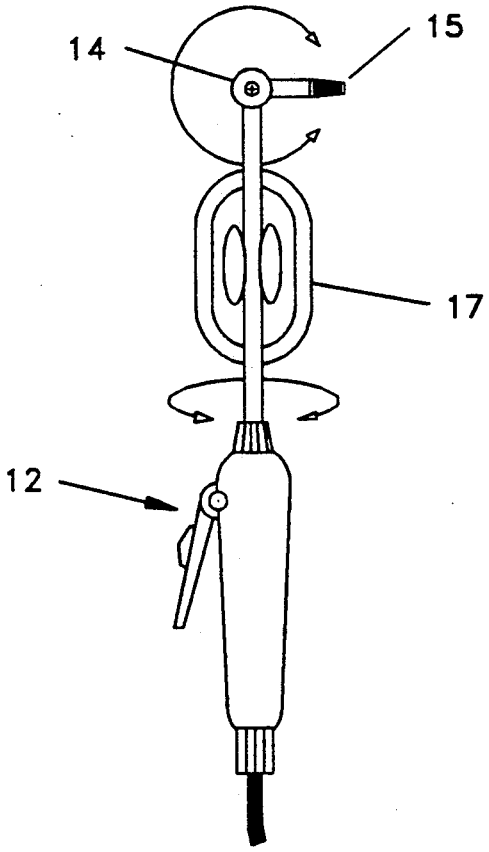
FIG. 4 is an enlarged view of the enclosure wall attachment with the sprayer wand in place.

FIG. 4 is a close up view of sprayer wand assembly parked in the surrounding wall mounted wand holder 17 which allows complete freedom of nozzle 15 positioning.

Figure 5:
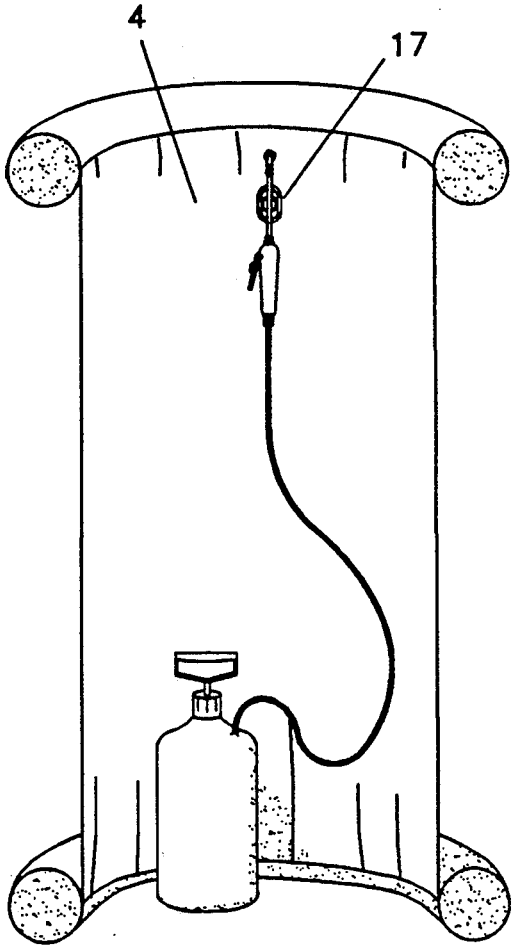
FIG. 5 is a perspective cutaway view of the self standing enclosure and the pump sprayer as it may be configured for use.

FIG. 5 shows the inside of the shower enclosure as it may be configured for use.

OPERATION FIG. 3

The shower enclosure is laid on the ground with the bottom ring 1 down. The bottom ring is inflated by inserting the nozzle 16 of the air pump assembly 10 into the air fill port opening 8 and stroking the pump until it is sufficiently inflated. The bottom ring 1 is staked to ground using the flapped eyelets 6 and stakes 7. Next, the columns 3 are inflated individually in the same manner as above (inflator port are not shown). The top ring 2 is inflated last. Setup of the shower enclosure is complete.

Water of suitable temperature is poured into the pump bottle 9. The pump assembly 10 is tightly secured to the bottle and pressurized by stroking the pump.

A user would step through shower enclosure opening 3 bringing the sprayer along. FIG. 5 shows how the sprayer assembly could be configured for use by setting the sprayer bottle on the ground and snapping the wand 13 into the wand holder 17 of the shower enclosure. The person would disrobe and press and lock the wand valve 12 and take a shower. The wand 13 can be removed from the wand holder 17 in order to direct the sprayer stream more effectively.

The user can now dry off, dress and exit the shower enclosure with the sprayer. The shower enclosure may then be deflated, unstaked and folded.

SUMMARY, RAMIFICATION, AND SCOPE

In view of the foregoing, it should be apparent to the reader that the portable shower equipment of this invention is simple to erect and dismantle, easier and safer to use, and is economical to manufacture. Further advantages are

- it obviates the additional need for overhead structures for erection;
- it has few parts and pieces;
- it folds up tightly and can be fit into a backpack easily;
- the shower enclosure and sprayer can be used independently for other outdoor or remote location needs.

The above discussion is intended to highlight the preferred embodiments of this invention and not to be considered limiting in any way. The scope of this invention should be determined by the appended claims and their legal equivalents, not the example stated above.

I claim:

1. A portable showering device comprising:

a self standing enclosure comprised of a surrounding wall of flexible material with a vertical overlapped entrance, an inflatable bottom ring adapted to be filled with air or water and formed of said flexible material and permanently attached to a bottom edge of said surrounding wall, a plurality of vertical air inflatable columns formed of said flexible material and permanently attached to a top edge of said surrounding wall comprising an air inflatable top ring such that when said self standing enclosure is inflated a person may enter and obtain privacy for showering;

means for introducing a water spray into said enclosure for showering; and, anchoring means for anchoring said enclosure to the ground.

2. The showering device according to claim 1 wherein said means for introducing a water spray further comprises:

a pressurizable water container having a detachable pump and a spray wand in communication with said pressurizable water container by a hose of sufficient length, said spray wand having a positionable nozzle; and, said detachable pump including means for allowing said pump to inflate said plurality of vertical air inflatable columns, said top ring, and said bottom ring when said pump is detached from said container.

3. The shower device according to claim 2 wherein said enclosure further includes a clamp which is permanently attached to said enclosure, for allowing said spray wand to be detachably connected to said enclosure.

* * * * *